US009733586B2

(12) United States Patent
Yoshimura et al.

(10) Patent No.: US 9,733,586 B2
(45) Date of Patent: Aug. 15, 2017

(54) RESIN COMPOSITE PARTICLE, ELECTROSTATIC CHARGE IMAGE DEVELOPING TONER, AND ELECTROSTATIC CHARGE IMAGE DEVELOPER

(71) Applicant: FUJI XEROX CO., LTD., Tokyo (JP)

(72) Inventors: Kousaku Yoshimura, Kanagawa (JP); Tomohiro Shinya, Kanagawa (JP); Kiyohiro Yamanaka, Kanagawa (JP); Shinpei Takagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/018,527

(22) Filed: Feb. 8, 2016

(65) Prior Publication Data

US 2017/0052466 A1 Feb. 23, 2017

(30) Foreign Application Priority Data

Aug. 20, 2015 (JP) ..... 2015-163226

(51) Int. Cl.
*G03G 9/087* (2006.01)
*G03G 9/093* (2006.01)

(52) U.S. Cl.
CPC ..... *G03G 9/08755* (2013.01); *G03G 9/08706* (2013.01); *G03G 9/09328* (2013.01); *G03G 9/09364* (2013.01); *G03G 9/09392* (2013.01)

(58) Field of Classification Search
CPC ..... G03G 9/08755; G03G 9/08708
See application file for complete search history.

(56) References Cited

U.S. PATENT DOCUMENTS

| | | | | |
|---|---|---|---|---|
| 5,536,612 | A | 7/1996 | Yamaguchi et al. | |
| 2004/0115549 | A1* | 6/2004 | Ishii | G03G 9/091 430/108.23 |
| 2012/0258393 | A1* | 10/2012 | Zhou | G03G 9/0819 430/108.11 |
| 2015/0118613 | A1* | 4/2015 | Nosella | G03G 9/08711 430/109.3 |
| 2015/0268573 | A1* | 9/2015 | Iwazaki | G03G 9/0806 430/105 |
| 2016/0161873 | A1* | 6/2016 | Wolfe | G03G 9/09371 430/110.2 |
| 2017/0010554 | A1* | 1/2017 | Veregin | G03G 9/1131 |
| 2017/0060012 | A1* | 3/2017 | Kamada | G03G 9/08755 |

FOREIGN PATENT DOCUMENTS

| | | | |
|---|---|---|---|
| JP | S63-186703 | A | 8/1988 |
| JP | H05-301933 | A | 11/1993 |
| JP | H06-317925 | A | 11/1994 |
| JP | 2003-292548 | A | 10/2003 |
| JP | 2003-292549 | A | 10/2003 |
| JP | 2006-002109 | A | 1/2006 |
| JP | 2009-249573 | A | 10/2009 |

* cited by examiner

*Primary Examiner* — Hoa V Le
(74) *Attorney, Agent, or Firm* — Oliff PLC

(57) ABSTRACT

A resin composite particle includes a continuous phase formed of a polyester resin, and a dispersed phase formed of a vinyl resin and dispersed in the continuous phase, the volume average particle diameter of the resin composite particles being from 50 nm to 1,000 nm.

12 Claims, 3 Drawing Sheets

RESIN COMPOSITE PARTICLE, ELECTROSTATIC CHARGE IMAGE DEVELOPING TONER, AND ELECTROSTATIC CHARGE IMAGE DEVELOPER

CROSS-REFERENCE TO RELATED APPLICATIONS

This application is based on and claims priority under 35 USC 119 from Japanese Patent Application No. 2015-163226 filed Aug. 20, 2015.

BACKGROUND

1. Technical Field

The present invention relates to a resin composite particle, an electrostatic charge image developing toner, and an electrostatic charge image developer.

2. Related Art

Various resin composite particles have been proposed.

SUMMARY

According to an aspect of the invention, there is provided a resin composite particle including:

a continuous phase formed of a polyester resin; and a dispersed phase formed of a vinyl resin and dispersed in the continuous phase, a volume average particle diameter of the resin composite particles being from 50 nm to 1,000 nm.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described. The descriptions and examples of these exemplary embodiments are merely provided for illustrating the exemplary embodiments and are not intended to limit the scope of the invention.

In the specification, the term "electrostatic charge image developing toner" is also simply referred to as "toner" and the term "electrostatic charge image developer" is also simply referred to as "developer".

Resin Composite Particle

The resin composite particle according to an exemplary embodiment has a continuous phase formed of a polyester resin and a dispersed phase formed of a vinyl resin dispersed in the continuous phase, and the volume average particle diameter (D50v) of the resin composite particles is from 50 nm to 1,000 nm.

Figure 3:
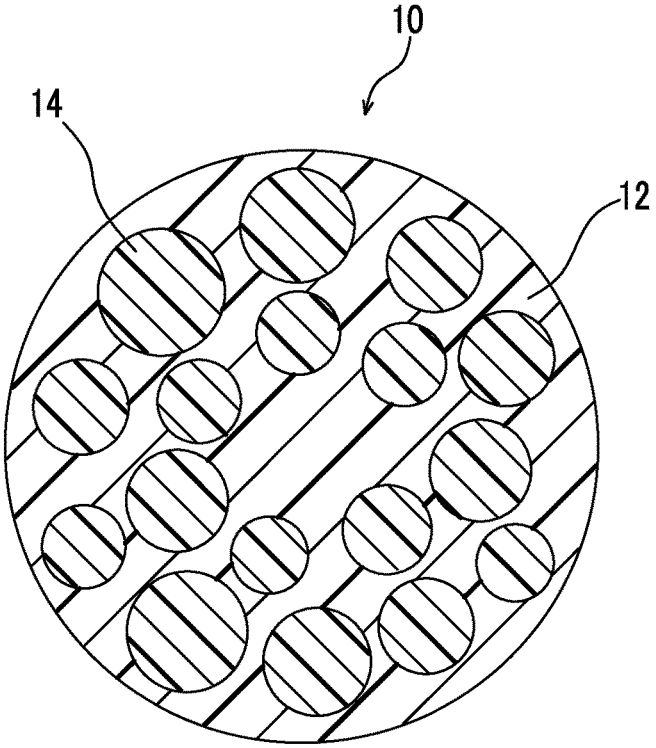
FIG. 3 is a schematic cross-sectional view illustrating a resin composite particle according to an exemplary embodiment.

FIG. 3 is a schematic view illustrating the resin composite particle according to the exemplary embodiment. As shown in FIG. 3, in the resin composite particle 10, a dispersed phase 14 formed of a vinyl resin is included in a continuous phase 12 formed of a polyester resin.

In other words, in the resin composite particle according to the exemplary embodiment, plural vinyl resin particles are included in a polyester resin particle, and the volume average particle diameter (D50v) of the resin composite particles is from 50 nm to 1,000 nm.

The resin composite particle according to the exemplary embodiment is provided in the form of a dispersion including the resin composite particles, a dried powder of resin composite particles, or the like.

In the related art, a polyester resin has been used as a base material for various resin products. On the other hand, since the physical properties formed of a vinyl resin is generally easily adjusted compared to a polyester resin, a vinyl resin is used in combination together with a polyester resin for the purpose of adjusting the characteristics of a resin product having a polyester resin as a main resin component (in the specification, referred to as "polyester resin product").

The resin composite particle according to the exemplary embodiment has a continuous phase formed of a polyester resin, and accordingly, the polyester resin is present on the surface of the particle. Thus, the resin composite particles may be easily blended at the time of preparing a polyester resin product and the characteristics of the polyester resin product may be easily adjusted by using a vinyl resin. Moreover, since the vinyl resin in the resin composite particle according to the exemplary embodiment is included as a dispersed phase (of course, particle smaller than the resin composite particle), the vinyl resin is arranged as a dispersed phase having a nanometer order particle diameter in the polyester resin product in which the resin composite particles are blended.

Since the dispersed phase (vinyl resin particles) derived from the resin composite particles according to the exemplary embodiment arranged in the polyester resin product has a small diameter of a nanometer order, it is assumed that (1) the effect of enhancing the hardness of the polyester resin product (also referred to as a filler effect) is exhibited, (2) the storage elastic modulus of the polyester resin product is increased, and further, (3) the transparency or the original color of the polyester resin product is not easily deteriorated.

Accordingly, the resin composite particles according to the exemplary embodiment may be applied to various uses, for example, a toner, an adhesive, a coating material, a resin molded article such as a drink bottle, or a device housing, an optical material such as a lens, a resin for a 3D printer, and a nanoimprint mold, and are useful.

For example, in the technical field of toner, toner particles containing a polyester resin as a binder resin and vinyl resin particles as a dispersed phase have been known. The resin composite particles according to the exemplary embodiment are easily blended in toner particles including a polyester resin as a binder resin and vinyl resin particles having a nanometer order particle diameter may be arranged in the toner particles.

In addition, as toner particles, toner particles having a so-called core-shell structure composed of a core (core particle) and a coating layer (shell layer) that is coated on the core have been known. When the resin composite particles according to the exemplary embodiment are used for forming a core, vinyl resin particles having a nanometer order particle diameter may be arranged in the core and when the resin composite particles are used for forming a coating layer, vinyl resin particles having a nanometer order particle diameter may be arranged in the coating layer.

When the vinyl resin particles derived from the resin composite particles according to the exemplary embodiment is arranged in the toner particles, the characteristics of toner may be adjusted by using the vinyl resin and the filler effect of the vinyl resin particles having a nanometer order particle diameter is exhibited.

Particularly, in the toner particles having a so-called core-shell structure, when the vinyl resin particles derived from the resin composite particles according to the exemplary embodiment are arranged in the coating layer, the filler effect of the vinyl resin particles is high. This is because the vinyl resin particles having a small diameter of a nanometer order are arranged to be closer to the surfaces of the toner particles. Thus, an external additive is prevented from being embedded in the toner particles and as a result, aggregation of toner particles and an image defect caused by the aggregation of toner particles are prevented.

In addition, since the filler effect is effectively exhibited as described above, the amount of the vinyl resin blended may be prevented. The vinyl resin particles are present in the continuous phase formed of the polyester resin of the resin composite particle and thus the vinyl resin particles are prevented from being exposed when the vinyl resin particles are arranged to be closer to the surfaces of the toner particles. Accordingly, when the resin composite particles according to the exemplary embodiment are applied to the coating layer, the low temperature fixability of a toner is less likely to be deteriorated.

Hereinafter, the resin composite particle according to the exemplary embodiment will be described in detail.

Structure of Resin Composite Particle

In the resin composite particle according to the exemplary embodiment, the polyester resin and the vinyl resin are mixed in an incompatible state and the vinyl resin, which is a dispersed phase, is included in the polyester resin, which is a continuous phase. In other words, in the resin composite particle according to the exemplary embodiment, plural vinyl resin particles are included in the polyester resin particle.

The volume average particle diameter (D50v) of the resin composite particles is from 50 nm to 1,000 nm.

When the volume average particle diameter of the resin composite particles is 1,000 nm or less, the vinyl resin particles included in the resin composite particle have a particle diameter of a nanometer order. Accordingly, the vinyl resin particles are arranged in a polyester resin product in which the resin composite particles are blended as a dispersed phase having a particle diameter of a nanometer order. The volume average particle diameter of the resin composite particles is preferably 800 nm or less and more preferably 600 nm or less.

On the other hand, when the volume average particle diameter of the resin composite particles is 50 nm or more, the vinyl resin is stably included as a dispersed phase. The volume average particle diameter of the resin composite particles is preferably 60 nm or more and more preferably 80 nm or more.

The volume average particle diameter (D50v) of the resin composite particles is preferably from 100 nm to 500 nm. When the volume average particle diameter of the resin composite particles is within the above range, a dispersion that contains the resin composite particles is preferably used as a resin particle dispersion to be used when toner particles are prepared in an aggregation and coalescence method.

The volume average particle diameter (D50v) of the resin composite particles is more preferably from 100 nm to 300 nm and even more preferably from 150 nm to 300 nm. From the viewpoint of easiness in preparing of resin composite particles, the volume average particle diameter of the resin composite particles is preferably 100 nm or more and more preferably 150 nm or more. On the other hand, when the volume average particle diameter of the resin composite particles is 300 nm or less, a dispersion that contains the resin composite particles is preferably used as a resin particle dispersion used for forming a shell layer when toner particles having a core-shell structure are prepared in an aggregation and coalescence method.

Regarding the volume average particle diameter of the resin composite particles, in the case of resin composite particles in a dispersion, a cumulative distribution is drawn from the side of the smallest diameter using the particle size distribution obtained by the measurement using a laser diffraction type particle size distribution measuring device (for example, LA-700, manufactured by Horiba, Ltd.) and a particle diameter when the volume cumulative percentage becomes 50% is determined as a volume average particle diameter (D50v).

Regarding the volume average particle diameter of the resin composite particles, in the case in which the resin composite particles are in the form of a dried powder, a cumulative distribution is drawn from the side of the smallest diameter using a particle size distribution obtained by the measurement using a scanning electron microscopic (SEM) (for example, S4700, manufactured by Hitachi, Ltd.) and a particle diameter when the volume cumulative percentage becomes 50% is determined as a volume average particle diameter (D50v).

The volume average particle diameter (D50v) of the resin composite particles may be controlled by the volume average particle diameter of polyester resin particles included in a polyester resin particle dispersion used for preparing in a method of preparing resin composite particles, which will be described later.

The average particle diameter of the dispersed phase formed of the vinyl resin (vinyl resin particles) included in the resin composite particles is preferably from 10 nm to 50 nm.

When the average particle diameter of the dispersed phase formed of the vinyl resin (vinyl resin particles) is 50 nm or less, a filler effect is exhibited effectively in a polyester resin product in which the resin composite particles are blended and the transparency of the polyester resin product is less likely to be deteriorated. From this viewpoint, the average particle diameter of the dispersed phase formed of the vinyl resin (vinyl resin particles) is more preferably 45 nm or less, even more preferably 40 nm or less, and still even more preferably 35 nm or less.

On the other hand, when the average particle diameter of the dispersed phase formed of the vinyl resin (vinyl resin particles) is 10 nm or more, the toughness and moldability of the polyester resin are less likely to be deteriorated. From this viewpoint, the average particle diameter of the dispersed phase formed of the vinyl resin (vinyl resin particles) is more preferably 15 nm or more and even more preferably 20 nm or more.

The average particle diameter of the dispersed phase formed of the vinyl resin (vinyl resin particles) included in the resin composite particles is obtained by the following measurement method.

A dried powder of resin composite particles is dyed with ruthenium tetraoxide in a desiccator at 30° C. A TEM image of the dyed dried powder is obtained using a transmission electron microscope (TEM). In the TEM image, the long diameters (the maximum length connecting two arbitrary points on the outline) of all particles observed in 100 resin composite particles, which are randomly extracted, are respectively measured to obtain the average value. The average value is determined as the average particle diameter of the dispersed phase formed of the vinyl resin (vinyl resin particles).

The average particle diameter of the dispersed phase formed of the vinyl resin (vinyl resin particles) may be controlled by the amount of vinyl monomers used for preparing in a method of preparing resin composite particles, which will be described later.

The content of the vinyl resin included in the resin composite particles is preferably from 10% by weight to 50% by weight with respect to the total resin composite particles.

When the content of the vinyl resin is 50% by weight or less, the vinyl resin is stably included as a dispersed phase. From this viewpoint, the content of the vinyl resin is more preferably 45% by weight or less and even more preferably 40% by weight or less.

On the other hand, when the content of the vinyl resin is 10% by weight or more, in the case in which the resin composite particles are blended in a polyester resin product, the characteristics of the polyester resin product is effectively adjusted by the vinyl resin. From this viewpoint, the content of the vinyl resin is more preferably 15% by weight or more and even more preferably 20% by weight or more.

Polyester Resin

Examples of the polyester resin contained in the resin composite particle according to the exemplary embodiment include known polyester resin. For example, polycondensates of polyvalent carboxylic acids and polyols may be used.

Specific examples of the polyester resin include polyester resins used as a binder resin in toner particles which will be described later.

In the case in which the resin composite particles according to the exemplary embodiment are applied to a toner, the glass transition temperature (Tg) of the polyester resin is preferably from 50° C. to 80° C., and more preferably from 50° C. to 65° C. The weight average molecular weight (Mw) of the polyester resin is preferably from 5,000 to 1,000,000, and more preferably from 7,000 to 500,000. The number average molecular weight (Mn) of the polyester resin is preferably from 2,000 to 100,000. The molecular weight distribution Mw/Mn of the polyester resin is preferably from 1.5 to 100 and more preferably from 2 to 60. The weight average molecular weight and the number average molecular weight of the polyester resin are measured in the following manner.

From the viewpoint of phase inversion emulsification, the acid value of the polyester resin (the amount by mg of KOH required for neutralizing 1 g of a resin) is preferably from 3 mgKOH/g to 30 mgKOH/g, more preferably 5 mgKOH/g to 25 mgKOH/g, and even more preferably from 6 mgKOH/g to 20 mgKOH/g. The acid value of the polyester resin is adjusted by controlling the amount of a carboxy group of the polyester resin according to the blending ratio and reaction rate between a polyvalent carboxylic acid and a polyol. The acid value of the polyester resin is measured by a neutralization titration method in accordance with JIS K0070.

Vinyl Resin

Examples of vinyl monomers used for obtaining a vinyl resin to be contained in the resin composite particle according to the exemplary embodiment include styrenes such as styrene, alkyl-substituted styrene (for example, α-methylstyrene, 2-methylstyrene, 3-methylstyrene, 4-methylstyrene, 2-ethylstyrene, 3-ethylstyrene, 4-ethylstyrene, and the like), halogen-substituted styrenes (for example, 2-chlorostyrene, 3-chlorostyrene, 4-chlorostyrene, and the like), and vinyl naphthalene; (meth)acrylic esters such as methyl (meth) acrylate, ethyl (meth)acrylate, n-propyl (meth)acrylate, n-butyl (meth)acrylate, lauryl (meth)acrylate, 2-ethylhexyl (meth)acrylate, phenyl (meth)acrylate, biphenyl (meth)acrylate, and trimethylolpropane trimethacrylate (TMPTMA); (meth)acrylic ester derivatives such as dimethylaminoethyl (meth)acrylate, diethylaminoethyl (meth)acrylate, methoxyethyl (meth)acrylate, 2-hydroxyethyl (meth)acrylate, and β-carboxyethyl (meth)acrylate; (meth)acrylamides and derivatives thereof; ethylenically unsaturated nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; acids having a vinyl group such as (meta)acrylic acid, maleic acid, cinnamic acid, fumaric acid, and vinyl sulfonic acid; and bases having a vinyl group such as ethylene imine, vinyl pyridine, and vinyl amine. The above expression "(meth)acryl" refers to both or any one of acryl and methacryl.

Examples of other monomers which may be copolymerized with the above monomers include monofunctional monomers such as vinyl acetate; difunctional monomers such as ethylene glycol dimethacrylate, nonane diacrylate, and decanediol diacrylate; and polyfunctional monomers such as trimethylolpropane triacrylate and trimethylolpropane trimethacrylate.

As the vinyl resin, homopolymers of the above-described monomers may be used or copolymers thereof may be used. As the vinyl resin, polymers of styrenes; and copolymers of styrenes and at least one selected from (meth)acrylic esters and (meth)acrylic acids; are preferable and here, styrenes may be used alone or in combination of two or more kinds thereof. As the styrenes, from the viewpoint of easiness of polymerization reaction and easiness of control of polymerization reaction, styrene is preferable.

The glass transition temperature (Tg) of the vinyl resin is, for example, from 40° C. to 200° C. and preferably from 50° C. to 150° C.

The glass transition temperature of the vinyl resin is preferably higher (for example, by more than 10° C.) than the glass transition temperature of polyester resin particles which constitute a binder resin when the resin composite particles according to the exemplary embodiment are applied to toner particles prepared by an aggregation and coalescence method. Thus, while the polyester resin particles which are to constitute a binder resin coalesce, the dispersed phase formed of the vinyl resin derived from the resin composite particles is prevented from coalescing or being compatible with the binder resin and thus the dispersed phase remains in the toner particle as it is.

The weight average molecular weight (Mw) of the vinyl resin is preferably from 10,000 to 1,000,000, and more preferably from 20,000 to 500,000.

The weight average molecular weight and the number average molecular weight of the vinyl resin are measured by gel permeation chromatography (GPC). The molecular weight measurement by GPC is performed using HLC-8120GPC which is GPC manufactured by Tosoh Corporation as a measuring device, TSKGEL Super HM-M (15 cm) which is a column manufactured by Tosoh Corporation, and a tetrahydrofuran (THF) as a solvent. The weight average molecular weight and the number average molecular weight are calculated using a molecular weight calibration curve plotted from a monodisperse polystyrene standard sample from the results of the above measurement.

The glass transition temperatures (Tg) of the polyester resin and the vinyl resin included in the resin composite particle according to the exemplary embodiment are obtained from a DSC curve obtained by differential scanning calorimetry (DSC). More specifically, the glass transition temperature is obtained from "extrapolated glass transition onset temperature" described in the method of obtaining a glass transition temperature in JIS K7121-1987 "testing methods for transition temperatures of plastics". The respective glass transition temperatures of the polyester resin and the vinyl resin are read out from plural peaks shown in the DSC curve.

Method of Preparing Resin Composite Particles

The resin composite particle according to the exemplary embodiment has a continuous phase formed of a polyester resin and a dispersed phase formed of a vinyl resin, and the volume average particle diameter of the resin composite particles is from 50 nm to 1,000 nm. As a method for preparing the resin composite particles, from the viewpoint of dispersing the vinyl resin in the polyester resin, a preparing method of polymerizing vinyl monomers in polyester resin particles is preferable. Specifically, a preparing method including a phase inversion emulsion process of obtaining polyester resin particle dispersion by subjecting a chlorinated polyester resin to phase inversion emulsion, and a polymerization process of polymerizing vinyl monomers in the polyester resin particles of the polyester resin particle dispersion may be exemplified as a preferable example. Here, the expression "in the polyester resin particles" refers to a region disposed on the inner side of the polyester resin particles than to the surface thereof.

The reasons why the above preparing method is preferable are considered as follows.

Since the polyester resin having a carboxy group which is chlorinated by abase is self-emulsifying, the carboxy group which is chlorinated by a base is directed to the outer side in the polyester resin particles obtained by subjecting the polyester resin to phase inversion emulsion. When vinyl monomers are placed into the polyester resin particle dispersion, it is assumed that the vinyl monomers easily enter the polyester resin particles. Then, in the resin composite particles obtained by polymerizing the vinyl monomers in the polyester resin particles, the vinyl resin is obtained as a dispersed phase by adjusting the amount of the vinyl monomers to be placed into the polyester resin particle dispersion.

Hereinafter, the aforementioned preferable example of the method of preparing the resin composite particles according to the exemplary embodiment will be described in detail.

Phase Inversion Emulsion Process

The phase inversion emulsion process includes respective processes of, for example, a dissolution process of preparing a polyester resin solution by dissolving a polyester resin in an organic solvent; a phase inversion process of obtaining a polyester resin particle dispersion by preparing a polyester resin chlorinated by mixing the polyester resin solution and a base, and further mixing water to conduct phase inversion emulsion; and an organic solvent removal process of removing the organic solvent from the polyester resin particle dispersion.

Dissolution Process

The dissolution process is a process of dissolving a polyester resin in an organic solvent. Examples of the organic solvent for dissolving the polyester resin include ketones such as acetone, methyl ethyl ketone, and methyl isobutyl ketone; ethers such as tetrahydrofuran, 1,4-dioxane, and 1,3-dioxane; halogen containing organic solvents such as chloroform and methylene chloride; alcohols such as n-butanol and isopropanol; and esters such as ethyl acetate. These organic solvents may be used alone or in combination of two or more kinds thereof. Among these organic solvents, from the viewpoint of removing the organic solvent in the subsequent process, an organic solvent having a boiling point lower than that of water is preferable and for example, organic solvents in which ketones and alcohols are used in combination are preferable.

The amount of the organic solvent used is preferably from 10 parts by weight to 200 parts by weight, more preferably from 20 parts by weight to 150 parts by weight, and even more preferably from 25 parts by weight to 100 parts by weight with respect to 100 parts by weight of the polyester resin from the viewpoint of the efficiency for obtaining a polyester resin particle dispersion, and the particle size distribution and dispersibility of the polyester resin particles in the subsequent process.

Phase Inversion Process

The phase inversion process is a process of obtaining a polyester resin particle dispersion by preparing a polyester resin chlorinated by mixing the polyester resin solution prepared in the dissolution process with a base and further mixing the polyester resin with water to conduct phase inversion emulsion.

The chlorinated polyester resin is a polyester resin having a structure in which a carboxy group is chlorinated by a base.

Examples of a base for obtaining the chlorinated polyester resin include amine compounds such as monomethylamine, dimethylamine, trimethylamine, monoethylamine, diethylamine, and triethylamine; and inorganic bases such as ammonia aqueous solution, sodium hydroxide, and potassium hydroxide.

The amount of the base to be mixed with the polyester resin solution is determined according to the amount of the carboxy group of the polyester resin from the viewpoint of conducting phase inversion emulsion of the polyester resin, and the amount of the base is preferably from 0.4 to 2.0 equivalents, and more preferably from 0.5 to 1.0 equivalent to the total carboxy group of the polyester resin. The acid value of the chlorinated polyester resin is preferably in a range of 5 mgKOH/g to 30 mgKOH/g and more preferably in a range of 5 mgKOH/g to 20 mgKOH/g.

After the polyester resin is chlorinated, the polyester resin is mixed with water to conduct phase inversion emulsion. The liquid containing the chlorinated polyester resin and water may be mixed at one time but preferably the liquid containing the chlorinated polyester resin and water may be slowly mixed. For example, a method in which water is added dropwise while stirring a liquid containing a chlorinated polyester resin at room temperature (for example, 20° C. to 25° C.) and is slowly mixed with the liquid may be used.

Organic Solvent Removal Process

The organic solvent removal process is a process of removing the organic solvent from the polyester resin particle dispersion obtained from the phase inversion process. The organic solvent may be removed under reduced pressure or normal pressure and under heating or without heating.

The volume average particle diameter of the polyester resin particles to be dispersed in the polyester resin particle dispersion obtained through the organic solvent removal process may be selected according to a target particle size of the resin composite particles. For example, the volume average particle diameter is from 50 nm to 1,000 nm, preferably from 100 nm to 500 nm, more preferably from 100 nm to 300 nm, and even more preferably from 150 nm to 300 nm.

Regarding the volume average particle diameter, a cumulative distribution by volume is drawn from the side of the smallest diameter with using the particle size distribution obtained by the measurement with a laser diffraction-type particle size distribution measuring device (for example, LA-700 manufactured by Horiba, Ltd.), and a particle diameter when the volume cumulative percentage becomes 50% is determined as a volume average particle diameter (D50v).

The content of the polyester resin particles included in the polyester resin particle dispersion is preferably from 1% by weight to 50% by weight and more preferably from 2% by weight to 40% by weight.

Polymerization Process

The polymerization process is a process of polymerizing a vinyl monomers in the polyester resin particles by mixing the polyester resin particle dispersion obtained in the phase inversion emulsion process and the vinyl monomers.

As a specific example of the method of the polymerization process, vinyl monomers and a chain transfer agent are mixed, and the mixture is emulsified with water and a surfactant to prepare a vinyl monomer emulsion. Next, the polyester resin particle dispersion and a polymerization initiator are mixed, and further, the aforementioned vinyl monomer emulsion is slowly mixed with the mixture. Thereafter, the resultant mixture is heated and thus the vinyl monomers are polymerized in the polyester resin particles.

The vinyl monomer emulsification may be optionally performed. For example, the vinyl monomer emulsification is performed by mixing vinyl monomers, a surfactant, and water and stirring the mixture with a dispersing machine.

The chain transfer agent and the surfactant are components which are optionally added.

Examples of the chain transfer agent include compounds having a thiol moiety such as hexylthiol, heptanethiol, octanethiol, nonanethiol, decanethiol, dodecanethiol, tetradecanethiol, and hexadecanethiol.

Examples of the polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydroperoxide pertriphenylacetate, tert-butyl performate, tert-butyl peracetate, tert-butyl perbenzoate, tert-butyl perphenylacetate, tert-butyl permethoxyacetate, tert-butyl per-N-(3-toluyl)carbamate, ammonium bisulfate, and sodium bisulfate; and azo compounds such as 2,2'-azobis(isobutyronitrile) (AIBN) and 2,2'-azobis-(2,4'-dimethylvaleronitrile).

In the exemplary embodiment, from the viewpoint of arranging the vinyl resin in the polyester resin particles as a dispersed phase, the amount of the vinyl monomers to be added to the polyester resin particle dispersion is preferably from 10% by weight to 50% by weight and more preferably from 10% by weight to 40% by weight with respect to the total amount of the polyester resin particles and the vinyl monomers.

From the viewpoint of incorporating the vinyl monomers into the polyester resin particles, it is preferable that the vinyl monomers are slowly mixed with the polyester resin particles and for example, dropwise addition is preferable.

The temperature at which the vinyl monomers are polymerized in the polyester resin particles is preferably from a temperature 30° C. lower than the glass transition temperature of the polyester resin to a temperature 30° C. higher than the glass transition temperature of the polyester resin.

The resin composite particles according to the exemplary embodiment are provided in the form of, for example, a dispersion including the resin composite particles. The dispersion is, for example, a reaction liquid after the phase inversion process and the polymerization process.

The amount (solid content amount) of the resin composite particles included in the dispersion of the resin composite particles is, for example, from 5% by weight to 50% by weight and preferably from 10% by weight to 40% by weight.

The resin composite particles according to the exemplary embodiment are provided in the form of, for example, a dried powder. The dried powder of resin composite particles is obtained by drying (for example, freeze drying, flash jet drying, fluidized drying, vibrating fluidized drying, vacuum drying, and the like) the reaction liquid after the phase inversion process and the polymerization process. Before the drying, displacement washing by ion exchange water, and solid-liquid separation by suction filtration, or pressure filtration may be performed.

Electrostatic Charge Image Developing Toner

As an example of use of the resin composite particles according to the exemplary embodiment, an example in which the resin composite particles are applied to a toner will be described. The use of the resin composite particles is not limited thereto.

A toner according to this exemplary embodiment includes toner particles, and optionally, an external additive.

The toner according to the exemplary embodiment includes toner particles that contain a binder resin including a polyester resin and have a dispersed phase formed of a vinyl resin derived from the resin composite particles according to the exemplary embodiment.

In the related art, for the purpose of adjusting the characteristics of a toner, a technique of using a vinyl resin in combination with a polyester resin has been known. According to the resin composite particles according to the exemplary embodiment, in the toner particle containing a polyester resin as a binder resin, a vinyl resin may be arranged as a dispersed phase.

Toner Particles

The toner particle contains a binder resin including a polyester resin and have a dispersed phase formed of a vinyl resin (vinyl resin particles) derived from resin composite particles according to the exemplary embodiment. The toner particle may further include a colorant, a release agent, and other additives.

The toner particle may have a single layer structure, or a so-called core-shell structure composed of a core (core particle) and a coating layer (shell layer) that is coated on the core.

In the case of toner particle having a core-shell structure, it is preferable that the toner particle is provided with, a core configured to include at least a polyester resin, and a coating layer configured to include at least a polyester resin, and have at least a dispersed phase formed of a vinyl resin derived from the resin composite particles according to the exemplary embodiment in the coating layer. The core may have a colorant, a release agent, and other additives.

When the toner particle having a core-shell structure has a dispersed phase formed of a vinyl resin derived from the resin composite particles according to the exemplary embodiment in the shell layer, the hardness of the surfaces of the toner particles is increased and an external additive is prevented from being embedded. As a result, aggregation of toner particles and an image defect caused by aggregation of toner particles are prevented.

Dispersed Phase of Vinyl Resin Derived from Resin Composite Particles

In the toner according to the exemplary embodiment, the toner particle has a dispersed phase formed of a vinyl resin (vinyl resin particles) derived from the resin composite particles. The toner particle may include the dispersed phase formed of the vinyl resin by, for example, using the resin composite particles according to the exemplary embodiment when the toner particle is prepared by an aggregation and coalescence method.

It is preferable that the size of the dispersed phase formed of the vinyl resin included in the toner particle reflects the size of the dispersed phase formed of the vinyl resin in the resin composite particles according to the exemplary embodiment. Specifically, the size of the dispersed phase formed of the vinyl resin is preferably an average size of 10 nm to 50 nm. The average size of the dispersed phase formed of the vinyl resin in the toner particles is obtained in the following measurement method.

The toner is mixed with an epoxy resin and the epoxy resin is solidified. The obtained solid material is cut using an ultramicrotome (ULTRACUT UCT, manufactured by Leica Microsystems) to prepare a flake sample having a thickness of 80 nm to 130 nm. Next, the flake sample is dyed with ruthenium tetraoxide in a desiccator at 30° C. for 3 hours. Then, a TEM image of the dyed flake sample is obtained using a transmission electron microscope (TEM). Each component is recognized according to shading caused by dyeing degrees. In a case where the shading is difficult to determine due to the state of the sample, the dyeing time is adjusted.

The cross sections of toner particles having various sizes are included in the TEM image, and the cross sections of toner particles in which the long diameter (the maximum length connecting two arbitrary points on the outline) is 85% or more of the volume average particle diameter of the toner particles are selected. Among the cross sections of the toner particles, the cross sections of 20 toner particles are randomly selected and are observed. The reason for selecting the cross sections of the toner particles as described above is that a cross section in which the long diameter is less than 85% of the volume average particle diameter is presumed as a cross section of the end of the toner particle, and a state of a domain in the toner particle is not sufficiently reflected in the cross section of the end of the toner particle.

The long diameters (the maximum length connecting two arbitrary points on the outline) of all the dispersed phases formed of the vinyl resin shown in the cross sections of 20 toner particles selected as described above are measured and an average value thereof is obtained. The obtained average value is determined as an average diameter of the dispersed phases formed of the vinyl resin in the toner particles.

In the case of toner particle having a core-shell structure, it is preferable that at least the coating layer has the dispersed phase formed of the vinyl resin derived from the resin composite particles.

The amount of the vinyl resin derived from the resin composite particles included in the coating layer (that is, the amount of vinyl resin constituting the dispersed phase in the coating layer) is preferably in a range of 1% by weight to 5% by weight with respect to the total toner particles. When the amount of the vinyl resin is 1% by weight or more, the filler effect of the dispersed phase formed of the vinyl resin is effectively exhibited. From this viewpoint, the amount of the vinyl resin is more preferably 2% by weight or more and even more preferably 3% by weight or more. On the other hand, when the amount of the vinyl resin is 5% by weight or less, the low temperature fixability of the toner is less likely to be deteriorated.

Binder Resin

Examples of the binder resins include a homopolymer composed of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin as described above, or a graft polymer obtained by polymerizing a vinyl monomer in the presence thereof.

These binder resins may be used singly or in combination with two or more kinds thereof.

The toner particles at least contain a polyester resin. Examples of the polyester resin include a condensed polymer of a polyvalent carboxylic acid and a polyol.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

A glass transition temperature (Tg) of the polyester resin is preferably from 50° C. to 80° C., more preferably from 50° C. to 65° C.

The glass transition temperature (Tg) is determined by a DSC curve obtained by differential scanning calorimetry (DSC), and more specifically, is determined by "extrapolation glass transition starting temperature" disclosed in a method of determining the glass transition temperature of JIS K7121-1987 "Testing Methods for Transition Temperature of Plastics".

A weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed with a THF solvent using HLC-8120 GPC, which is GPC manufactured by Tosoh Corporation as a measurement device by using TSKGEL Super HM-M (15 cm), which is a column manufactured by Tosoh Corporation. The weight-average molecular weight and the number-average molecular weight are calculated using a calibration curve of molecular weight created with a monodisperse polystyrene standard sample from results of this measurement.

The polyester resin is obtained with a well-known preparing method. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

For example, the content of the binder resin is from 40% by weight to 95% by weight, more preferably from 50% by weight to 90% by weigh, and still more preferably from 60% by weight to 85% by weight with respect to the total toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight, and more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight and more preferably from 5% by weight to 15% by weight, with respect to the entirety of the toner particles.

Other Additives

Examples of the additive include known additives such as a magnetic substance, a charge-controlling agent, an inorganic power, and other colorant than the brilliant pigment. These additives may be incorporated into a toner particle as an inner additive.

Characteristics of Toner Particles

The toner particle may be toner particle having a single layer structure, or may be toner particle having a so-called core-shell structure composed of a core (core particle) and a coating layer (shell layer) coated on the core. The toner particle having a core-shell structure may preferably be composed of, for example, a core configured to include a binder resin, and if necessary, other additives such as a colorant and a release agent, and a coating layer configured to include a binder resin and the dispersed phase formed of the vinyl resin derived from the resin composite particles according to the exemplary embodiment.

The volume average particle size (D50v) of the toner particles is preferably from 2 μm to 10 μm, and more preferably from 4 μm to 8 μm.

Various average particle sizes and various particle size distribution indices of the toner particles are measured using a COULTER MULTISIZSER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle size of 2 μm to 60 μm is measured by a COULTER MULTISIZER II using an aperture having an aperture size of 100 μm. 50,000 particles are sampled.

Cumulative distributions by volume and by number are drawn from the side of the smallest size with respect to particle size ranges (channels) separated based on the measured particle size distribution. The particle size when the cumulative percentage becomes 16% is defined as that corresponding to a volume average particle size D16v and a number-average particle size D16p, while the particle size when the cumulative percentage becomes 50% is defined as that corresponding to a volume average particle size D50v and a number-average particle size D50p. Furthermore, the particle size when the cumulative percentage becomes 84% is defined as that corresponding to a volume average particle size D84v and a number-average particle size D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner, and A represents a projected area of a toner.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin particles) and a cleaning aid (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner according to this exemplary embodiment will be described.

The toner according to this exemplary embodiment is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

When the toner particles are prepared by an aggregation and coalescence method, from the viewpoint of affinity with the resin composite particles according to the exemplary embodiment, the toner particles preferably include a polyester resin as a binder resin and accordingly, as a resin particle dispersion, a polyester resin particle dispersion is preferable.

Specifically, for example, when the toner particles are prepared by an aggregation and coalescence method, the toner particles are prepared through the processes of: preparing a polyester resin particle dispersion in which polyester resin particles as a binder resin are dispersed (polyester resin particle dispersion preparation process); preparing a resin composite particle dispersion in which the resin composite particles according to the exemplary embodiment are dispersed (resin composite particle dispersion preparation process); aggregating the polyester resin particles and the resin composite particles (as necessary, other particles) by mixing the polyester resin particle dispersion and the resin composite particle dispersion (as necessary, other particle dispersions) to form aggregated particles (aggregated particle forming process); and heating the aggregated particle dispersion in which the aggregated particles are dispersed, to coalesce the aggregated particles, thereby forming toner particles (coalescence process).

When toner particles having a core-shell structure are prepared by an aggregation and coalescence method, the toner particles are prepared through the processes of: preparing a polyester resin particle dispersion in which polyester resin particles as a binder resin are dispersed (resin particle dispersion preparation process); preparing a resin composite particle dispersion in which the resin composite particles according to the exemplary embodiment are dispersed (resin composite particle dispersion preparation process); aggregating the polyester resin particles (as necessary, other particles) in the polyester resin particle dispersion (in the dispersion after mixing with other particle dispersions as necessary) to form first aggregated particles (first aggregated particle forming process); mixing the first aggregated particle dispersion in which the first aggregated particles are dispersed, the polyester resin particle dispersion and the resin composite particle dispersion and aggregating the polyester resin particles and the resin composite particles so as to adhere to the surfaces of the first aggregated particles to form second aggregated particles (second aggregated particle forming process); and heating the second aggregated particle dispersion in which the second aggregated particles are dispersed, to coalesce the second aggregated particles, thereby forming toner particles (coalescence process).

Hereinafter, each of the processes will be described in detail. In the following description, a method of preparing toner particles having a core-shell structure will be described. However, when toner particles having a single layer structure are prepared, the second aggregated particle forming process may be omitted and the resin composite particle dispersion may be mixed with the resin particle dispersion in the first aggregated particle forming process.

In the following description, a method of obtaining toner particles including a colorant and a release agent will be described. However, the colorant and the release agent are used as necessary. Additives other than the colorant and the release agent may be used. As the binder resin, resins other than a polyester resin may be further used.

Polyester Resin Particle Dispersion Preparation Process

A polyester resin particle dispersion is prepared by, for example, dispersing polyester resin particles in a dispersion medium by a surfactant.

Examples of the dispersion medium that is used for the polyester resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the polyester resin particle dispersion, as a method of dispersing the polyester resin particles in the dispersion medium, for example, a common dispersing method using, for example, a rotary shearing type homogenizer, or a ball mill, a sand mill, or a DYNO mill having media are exemplified. In addition, the polyester resin particles may be dispersed in the dispersion medium by a phase inversion emulsification method. The phase inversion emulsification method includes: dissolving a resin to be dispersed in a hydrophobic organic solvent in which the resin is soluble; and after conducting neutralization by adding abase to an organic continuous phase (O phase), performing converting the phase of the resin (so-called phase inversion) from W/O to O/W by adding an aqueous medium (W phase) to disperse the resin as particles in the aqueous medium.

The volume average particle diameter of the polyester resin particles that are dispersed in the polyester resin particle dispersion is, for example, preferably from 0.01 μm to 1 μm, more preferably from 0.08 μm to 0.8 μm, and even more preferably from 0.1 μm to 0.6 μm. Here, regarding the volume average particle diameter of the resin particles, a cumulative distribution by volume is drawn from the side of the smallest diameter with respect to particle size ranges (channels) divided using the particle size distribution obtained by the measurement with a laser diffraction type particle size distribution measuring device (for example, LA-700, manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the polyester resin particles that are contained in the polyester resin particle dispersion is, for example, preferably from 5% by weight to 50% by weight, and more preferably from 10% by weight to 40% by weight.

For example, a colorant dispersion in which colorant particles are dispersed and a release agent dispersion in which release agent particles are dispersed are also prepared in the same manner as in the case of the polyester resin particle dispersion. The dispersion medium, the dispersing method, and the volume average particle diameter and content of the particles in the colorant dispersion and in the release agent dispersion are the same as those in the polyester resin particle dispersion.

The resin composite particle dispersion may be prepared by performing the aforementioned method of preparing the resin composite particles. The content of the particles in the resin composite particle dispersion is the same as the content of the particles in the polyester resin particle dispersion.

First Aggregated Particle Forming Process

Next, the colorant particle dispersion and the release agent dispersion are mixed together with the polyester resin particle dispersion.

The polyester resin particles, the colorant particles, and the release agent particles are heterogeneously aggregated in the mixed dispersion to form aggregated particles with a diameter close to a target toner particle diameter that include the polyester resin particles, the colorant particles, and the release agent particles.

Examples of the aggregating agent include a surfactant having a polarity opposite to the polarity of the surfactant that is used as the dispersant to be added to the mixed dispersion, inorganic metal salts and di- or higher-valent metal complexes. Particularly, when a metal complex is used as the aggregating agent, the amount of the surfactant to be used is reduced and charging characteristics are improved.

As necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

After the first aggregated particle dispersion in which the first aggregated particles are dispersed is obtained, the first aggregated particle dispersion, the polyester resin particle dispersion, and the resin composite particle dispersion are mixed. The polyester resin particle dispersion and the resin composite particle dispersion may be mixed in advance and the mixed dispersion may be mixed with the first aggregated particle dispersion.

In the mixed dispersion in which the first aggregated particles, the polyester resin particles, and the resin composite particles are dispersed, the polyester resin particles and the resin composite particles are aggregated so as to adhere to the surfaces of the first aggregated particles, thereby forming second aggregated particles.

Specifically, for example, in the first aggregated particle forming process, when the particle size of the first aggregated particles reaches a target particle size, the first aggregated particle dispersion is mixed with the polyester resin particle dispersion and the resin composite particle dispersion. At this time, in order to accelerate the aggregation of the polyester resin particles and the resin composite particles to the surfaces of the first aggregated particles, while continuously heating the first aggregated particle dispersion, the polyester resin particle dispersion and the resin composite particle dispersion may be mixed. Next, the aggregation is terminated by adjusting the pH of the mixed dispersion to be in a range of, for example, from 6.5 to 9.5.

Thus, second aggregated particles are obtained in which the polyester resin particles and the resin composite particles are aggregated so as to adhere to the surfaces of the first aggregated particles.

In the series of the operations, before aggregation is terminated by adjusting the pH, only the polyester resin particle dispersion may be further added so that the polyester resin particles adhere to the outermost surfaces of the aggregated particles.

Thus, the second aggregated particles are obtained in which the polyester resin particles and the resin composite particles are aggregated so as to adhere to the surfaces of the first aggregated particles and further the polyester resin particles are aggregated so as to adhere to the outermost surface of the aggregated particles.

In the resin composite particle dispersion, the amount of the vinyl resin included in the resin composite particles is preferably in a range of 1% by weight to 5% by weight with respect to the total solid content of the total dispersion.

In the above description, the case in which the resin composite particle dispersion is not used in the first aggregated particle forming process has been described. However, the resin composite particle dispersion may be also used in the first aggregated particle forming process. The amount of the vinyl resin included in the core particle and shell layer in the core-shell structure may be controlled according to the amount of the resin composite particle dispersion used in the first aggregated particle forming process and the second aggregated particle forming process. From the viewpoint of arranging the dispersed phase formed of the vinyl resin in the shell layer, the resin composite particle dispersion is preferably used at least in the second aggregated particle forming process.

Coalescence Process

Next, the second aggregated particle dispersion in which the second aggregated particles are dispersed is heated at, for example, a temperature that is equal to or higher than the glass transition temperature of the polyester resin particles as a binder resin (for example, a temperature that is higher than the glass transition temperature of the polyester resin particles as a binder resin by 10° C. to 30° C.) to coalesce the second aggregated particles and form toner particles having a core-shell structure.

The reaching temperature in the heating is preferably a temperature lower than the glass transition temperature of the vinyl resin included in the resin composite particles from the viewpoint of making the dispersed phase formed of the vinyl resin derived from the resin composite particles remain in the toner particles.

When the reaching temperature in the heating is set to a temperature which is equal to or higher than the glass transition temperature of the polyester resin particles as a binder resin and lower than the glass transition temperature of the vinyl resin included in the resin composite particles, while the polyester resin particles as a binder resin coalesce, the dispersed phases formed of the vinyl resin derived from the resin composite particles are prevented from coalescing or being compatible with the binder resin and thus the dispersed phase remains in the toner particles as it is.

Accordingly, in the preparing method, as the vinyl resin included in the resin composite particles, a vinyl resin having a glass transition temperature more than 10° C. higher than the glass transition temperature of the polyester resin particles which constitute a binder resin in the toner particles is preferable.

The polyester resin included as a continuous phase in the resin composite particle typically coalesce with the polyester resin particle used as the binder resin by the coalescence process.

Through the above processes, toner particles are obtained.

After the coalescence process, the toner particles are subjected to a washing process, a solid-liquid separation process, and a drying process to obtain dried toner particles. The method for the washing process is not particularly limited but, preferably, displacement washing with ion exchange water may be sufficiently performed from the viewpoint of chargeability. The method for the solid-liquid separation process is not particularly limited, but suction filtration, pressure filtration, or the like may preferably be performed from the viewpoint of productivity. The method for the drying process is also not particularly limited, but freeze drying, flash jet drying, fluidized drying, vibration type fluidized drying, or the like may preferably be performed from the viewpoint of productivity.

Then, the toner according to the exemplary embodiment may be prepared by adding an external additive to the obtained dry toner particles and mixing the materials.

The mixing may be performed by using a V blender, a HENSHEL mixer, a ready-gel mixer, and the like.

Further, if necessary, coarse toner particles may be removed by using a vibration classifier, a wind classifier, and the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particles.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved or dispersed in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that stores the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

Figure 1:
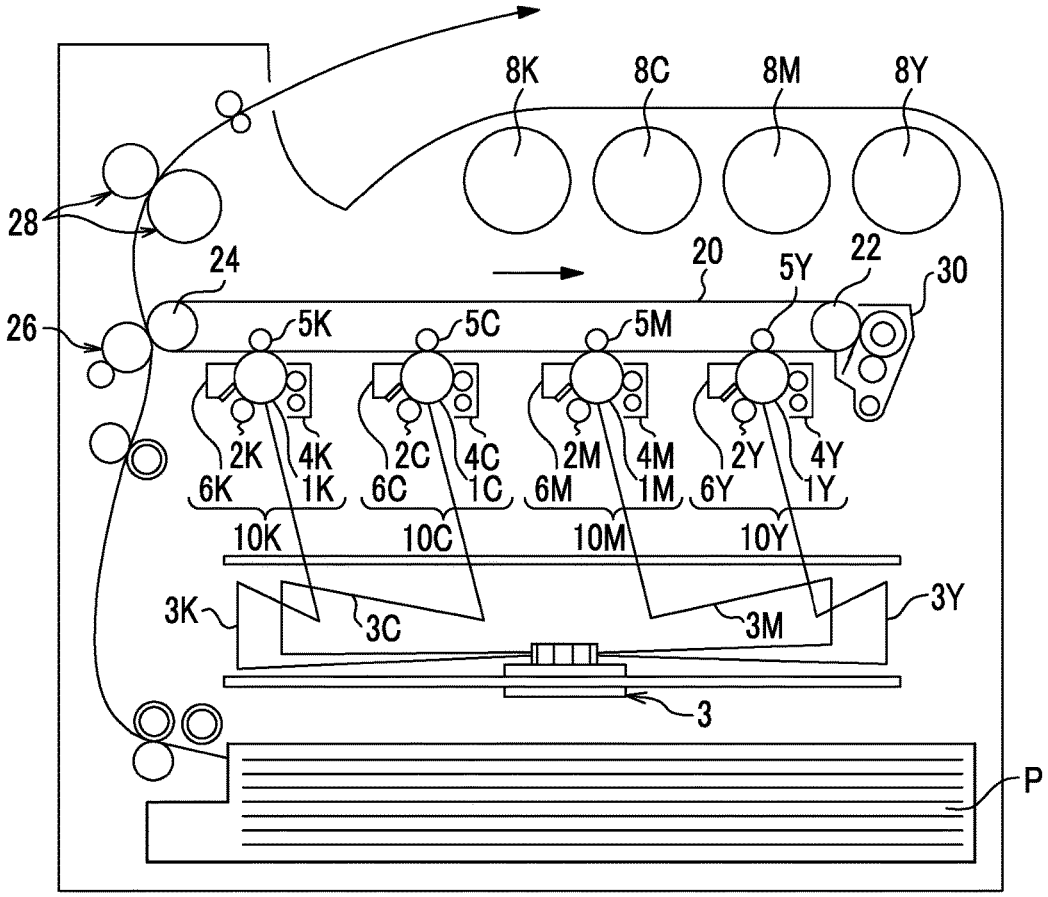
FIG. 1 is a schematic configuration view illustrating an example of an image forming apparatus according to an exemplary embodiment.

FIG. 1 is a configuration view illustrating showing a configuration of the image forming apparatus according to this exemplary embodiment.

The image forming apparatus shown in FIG. 1 is provided with first to fourth electrophotographic image forming units 10Y, 10M, 100, and 10K (image forming units) that output yellow (Y), magenta (M), cyan (C), and black (K) images based on color-separated image data, respectively. These image forming units (hereinafter, may be simply referred to as "units") 10Y, 10M, 100, and 10K are arranged side by side at predetermined intervals in a horizontal direction. These units 10Y, 10M, 10C, and 10K may be process cartridges that are detachable from the image forming apparatus.

An intermediate transfer belt 20 (an example of the intermediate transfer member) is installed above each of the units 10Y, 10M, 10C, and 10K in the drawing to extend through each unit. The intermediate transfer belt 20 is wound on a driving roll 22 and a support roll 24 contacting the inner surface of the intermediate transfer belt 20 and travels in a direction toward the fourth unit 10K from the first unit 10Y. The support roll 24 is pressed in a direction away from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

In addition, developing devices (examples of the developing unit) 4Y, 4M, 4C, and 4K of each of the units 10Y, 10M, 10C, and 10K are supplied with respective toners of a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5O, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y stores, for example, an electrostatic charge image developer including at least a yellow toner and a carrier. The yellow toner is frictionally charged by being agitated in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased electrostatic charge image part on the surface of the photoreceptor 1Y, whereby the electrostatic charge image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image and thus, the toner image on the photoreceptor 1Y is transferred onto the intermediate transfer belt 20. The transfer bias applied at this time has the opposite polarity (+) of the toner polarity (−), and, for example, is controlled to +10 μA in the first unit 10Y by the controller (not shown).

The primary transfer biases that are applied to the primary transfer rolls 5M, 5O, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that stores the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
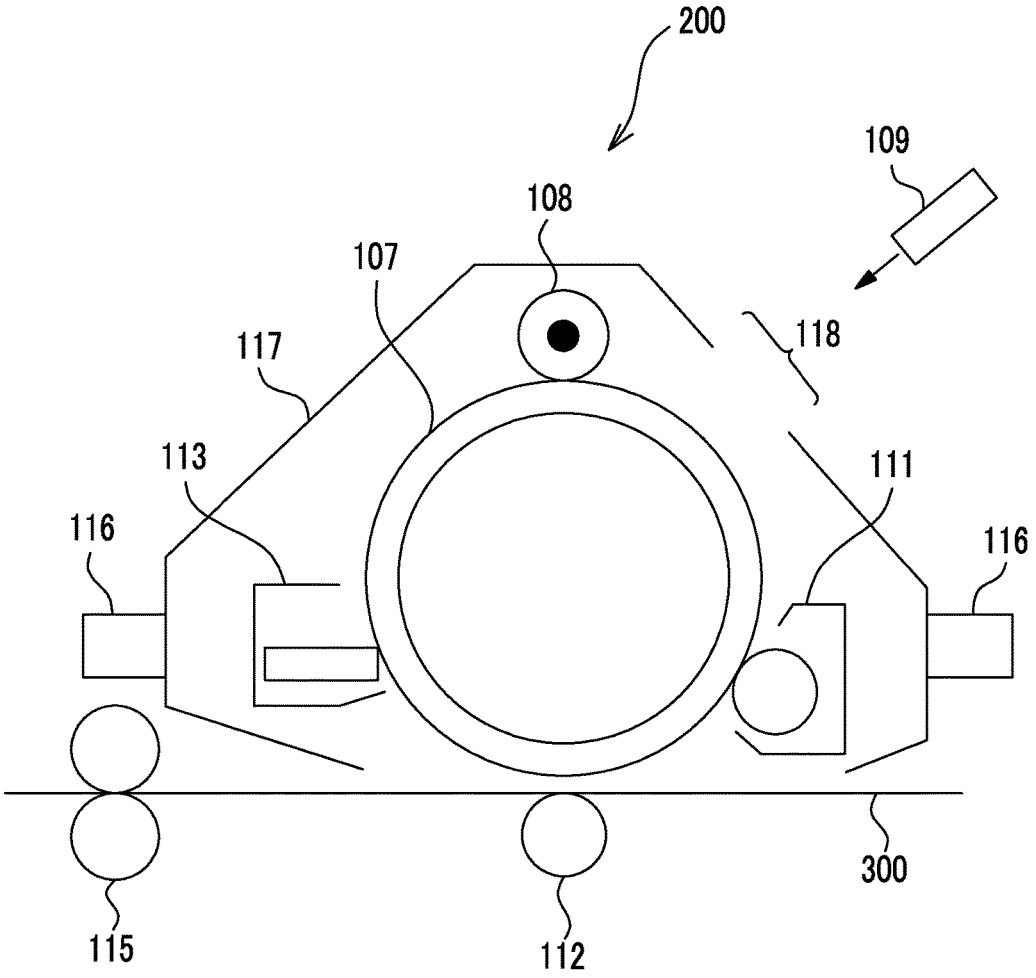
FIG. 2 is a schematic configuration view illustrating an example of a process cartridge according to an exemplary embodiment.

FIG. 2 is a configuration view illustrating showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure. In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment stores the toner according to this exemplary embodiment and is detachable from an image forming apparatus. The toner cartridge stores a toner in a storing portion for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner stored in the toner cartridge runs low, the toner cartridge is replaced.

Hereinafter, the exemplary embodiment will be described in detail using examples but the exemplary embodiment is not limited to the examples. Unless specifically noted, "parts" and "%" are based on weight.

Preparation of Resin Composite Particles

Synthesis of Polyester Resin (1)

Ethylene oxide (2 mol) adduct of bisphenol A: 50 mole parts

Propylene oxide (2 mol) adduct of bisphenol A: 50 mole parts

Terephthalic acid: 62 mole parts

Dodecenyl succinic anhydride: 31 mole parts

Trimellitic anhydride: 7 mole parts

The above-described materials are put into a reaction vessel provided with a stirrer, a thermometer, a condenser and a nitrogen gas introducing tube. The reaction vessel is purged with dry nitrogen gas. Then, 1.0 parts of dibutyltin oxide with respect to a total amount of 100 parts of the monomer components is added as a catalyst, and the resultant is allowed to react under stirring at 190° C. for 5 hours under a nitrogen gas stream. The temperature is further increased to 240° C. and the mixture is allowed to react under stirring for 6 hours. Then, the pressure inside the reaction vessel is reduced to 10.0 mmHg and the resultant is allowed to react under stirring for 0.5 hours under reduced pressure. Thus, a polyester resin (1) is obtained. The acid value of the polyester resin (1) is 14.0 mgKOH/g, the weight average molecular weight (Mw) is 24,000, and the glass transition temperature is 54° C.

Preparation of Polyester Resin Particle Dispersion (A1)

Into a reaction vessel, 50 parts of methyl ethyl ketone and 10 parts of isopropyl alcohol are put to thereby form a mixed solvent. Then, 100 parts of the polyester resin (1) is slowly added and dissolved and 4 parts of a 10% aqueous ammonia solution is added. Next, 200 parts of ion exchange water is added dropwise to the reaction vessel under stirring at room temperature (20° C. to 25° C.) for 2 hours. Then, the solvent is distilled off under reduced pressure and ion exchange water is added to adjust the solid content amount to 30%. Thus, a polyester resin particle dispersion (A1) is obtained. The volume average particle diameter (D50v) of the polyester resin particles in the polyester resin particle dispersion (A1) is 166 nm.

Preparation of Polyester Resin Particle Dispersion (A2)

A polyester resin particle dispersion (A2) having a volume average particle diameter of 118 nm is obtained in the same manner as in the preparation of the polyester resin particle dispersion (A1) except that 50 parts of methyl ethyl ketone is changed to 80 parts thereof and 10 parts of isopropyl alcohol is changed to 20 parts thereof.

Preparation of Polyester Resin Particle Dispersion (A3)

A polyester resin particle dispersion (A3) having a volume average particle diameter of 270 nm is obtained in the same manner as in the preparation of the polyester resin particle dispersion (A1) except that 50 parts of methyl ethyl ketone is changed to 40 parts thereof, 10 parts of isopropyl alcohol is changed to 5 parts thereof, and 4 parts of a 10% ammonia aqueous solution is changed to 3 parts thereof.

Preparation of Polyester Resin Particle Dispersion (A4)

A polyester resin particle dispersion (A4) having a volume average particle diameter of 80 nm is obtained in the same manner as in the preparation of the polyester resin particle dispersion (A1) except that 50 parts of methyl ethyl ketone is changed to 100 parts thereof, 10 parts of isopropyl alcohol is changed to 25 parts thereof, and 4 parts of a 10% ammonia aqueous solution is changed to 5 parts thereof.

EXAMPLE 1

Preparation of Resin Composite Particle Dispersion (P1)

Into a reaction vessel, 60 parts of styrene, 0.9 parts of dodecanethiol, 10 parts of a surfactant DOWFAX 2A1 (45% solution), and 40 parts of ion exchange water are put, and stirred with a dissolver at a stirring rotation speeds of 1,500 rpm for 30 minutes to conduct emulsification. Thus, a monomer emulsion is obtained.

Into another reaction vessel, 466.7 parts of the polyester resin particle dispersion (A1) and 23.3 parts of ion exchange water are put and the materials are heated to 75° C. under a nitrogen gas stream. Then, a solution obtained by dissolving 1.5 parts of ammonium persulfate as a polymerization initiator in 10 parts of ion exchange water is added and then the monomer emulsion is added dropwise for 150 minute. Reaction is conducted at 75° C. for 180 minutes under a nitrogen gas stream. The reaction solution is cooled and then ion exchange water is added to adjust the solid content amount to 30%. Thus, a resin composite particle dispersion (P1) is obtained.

EXAMPLE 2

Preparation of Resin Composite Particle Dispersion (P2)

A resin composite particle dispersion (P2) is obtained in the same manner as in Example 1 except that 60 parts of styrene is changed to 48 parts of styrene and 12 parts of n-butyl acrylate.

EXAMPLE 3

Preparation of Resin Composite Particle Dispersion (P3)

A resin composite particle dispersion (P3) is obtained in the same manner as in Example 1 except that 466.7 parts of the polyester resin particle dispersion (A1) is changed to 466.7 parts of the polyester resin particle dispersion (A2.).

EXAMPLE 4

Preparation of Resin Composite Particle Dispersion (P4)

A resin composite particle dispersion (P4) is obtained in the same manner as in Example 1 except that 466.7 parts of the polyester resin particle dispersion (A1) is changed to 466.7 parts of the polyester resin particle dispersion (A3).

EXAMPLE 5

Preparation of Resin Composite Particle Dispersion (P5)

A resin composite particle dispersion (P5) is obtained in the same manner as in Example 1 except that 466.7 parts of the polyester resin particle dispersion (A1) is changed to 466.7 parts of the polyester resin particle dispersion (A4).

EXAMPLE 6

Preparation of Resin Composite Particle Dispersion (P6)

A resin composite particle dispersion (P6) is obtained in the same manner as in Example 1 except that 466.7 parts of the polyester resin particle dispersion (A1) is changed to 533.3 parts of the polyester resin particle dispersion (A1), and 60 parts of styrene is changed to 40 parts of styrene.

EXAMPLE 7

Preparation of Resin Composite Particle Dispersion (P7)

A resin composite particle dispersion (P7) is obtained in the same manner as in Example 1 except that 466.7 parts of the polyester resin particle dispersion (A1) is changed to 400 parts of the polyester resin particle dispersion (A1), and 60 parts of styrene is changed to 80 parts of styrene.

COMPARATIVE EXAMPLE 1

Preparation of Polystyrene Resin Particle Dispersion (P1C)

Into a reaction vessel, 1,000 parts of styrene, 15.7 parts of dodecanethiol, 19.8 parts of a surfactant DOWFAX 2A1 (45% solution), and 576 parts of ion exchange water are put, and stirred with a dissolver at a stirring rotation speed of 1,500 rpm for 30 minutes to conduct emulsification. Thus, a monomer emulsion is obtained.

Into another reaction vessel, 1.49 parts of Dowfax 2A1 (45% solution) and 1,270 parts of ion exchange water are put, and the materials are heated to 75° C. under a nitrogen gas stream. Then, 75 parts of the monomer emulsion is added into the reaction vessel. Next, a solution obtained by dissolving 15 parts of ammonium persulfate as a polymerization initiator in 98 parts of ion exchange water is added dropwise for 10 minutes. After the dropwise addition, the materials are allowed to react while continuing stirring for 50 minutes, then the remaining monomer emulsion is added dropwise to the reaction vessel for 220 minutes, and the materials are further allowed to react while continuing stirring for 180 minutes. The reaction solution is cooled and then ion exchange water is added to adjust the solid content amount to 30%. Thus, a polystyrene resin particle dispersion (P1C) is obtained.

COMPARATIVE EXAMPLE 2

Preparation of Resin Composite Particle Dispersion (P2C)

A resin composite particle dispersion (P2C) is obtained in the same manner as in Example 1 except that 466.7 parts of the polyester resin particle dispersion (A1) is changed to 266.7 parts of the polyester resin particle dispersion (A1) and 60 parts of styrene is changed to 120 parts of styrene.

Evaluation of Resin Composite Particles

Structure of Resin Composite Particles

Figure 4:
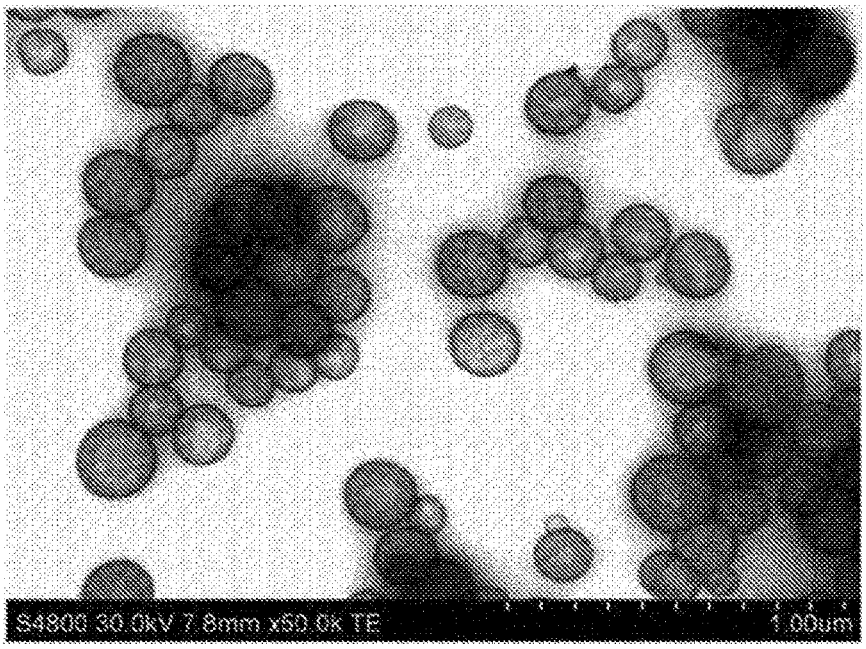
FIG. 4 is an image obtained by observing resin composite particles of Example 1 using a transmission electron microscope.

The resin composite particle dispersion is freeze-dried and thus a dried powder of resin composite particles is obtained. The dried powder is dyed with ruthenium tetraoxide and then the particles are observed with a transmission electron microscope to classify the structure of the particles as follows. FIG. 4 is an image obtained by observing the dried powder of resin composite particles of Example 1 with a transmission electron microscope.

Scientific, Inc.) to measure an elastic modulus in a temperature range of 40° C. to 110° C. Thus, a storage elastic modulus G' (Pa) at 80° C. is obtained. The storage elastic modulus G' of the disk of the dried powder formed of only the polyester resin particle dispersion (A1) is $3.5\times10^5$ Pa.

In Table 1, the characteristics of the respective resin composite particle dispersions or the polystyrene resin particle dispersion are shown. In Table 1, the term "PES" refers to polyester resin, the term "St" refers to styrene, and the term "BA" refers to n-butyl acrylate, respectively.

TABLE 1

| | Resin composite particle dispersion or polystyrene particle dispersion | PES particle dispersion | Vinyl monomer St:BA [weight ratio] | Resin composite particles: Content of vinyl resin | Resin composite particles: Particle structure | Resin composite particles: Volume average particle diameter | Resin composite particles: Average particle diameter of vinyl resin particles | Transparency | Storage elastic modulus G' [Pa] |
|---|---|---|---|---|---|---|---|---|---|
| Example 1 | P1 | A1 166 nm | 100:0 | 30% by weight | A | 180 nm | 25 nm | A | $6.6 \times 10^6$ |
| Example 2 | P2 | A1 166 nm | 80:20 | 30% by weight | A | 178 nm | 22 nm | A | $8.0 \times 10^6$ |
| Example 3 | P3 | A2 118 nm | 100:0 | 30% by weight | A | 129 nm | 26 nm | A | $4.8 \times 10^6$ |
| Example 4 | P4 | A3 270 nm | 100:0 | 30% by weight | A | 286 nm | 26 nm | A | $7.7 \times 10^6$ |
| Example 5 | P5 | A4 80 nm | 100:0 | 30% by weight | B | 88 nm | 48 nm | B | $3.5 \times 10^6$ |
| Example 6 | P6 | A1 166 nm | 100:0 | 20% by weight | A | 175 nm | 20 nm | A | $9.8 \times 10^6$ |
| Example 7 | P7 | A1 166 nm | 100:0 | 40% by weight | A | 186 nm | 32 nm | A | $4.4 \times 10^6$ |
| Comparative Example 1 | P1C | — — | 100:0 | 100% by weight | — | 191 nm | 191 nm | C | $9.2 \times 10^5$ |
| Comparative Example 2 | P2C | A1 166 nm | 100:0 | 60% by weight | C | 220 nm | 184 nm | C | $1.1 \times 10^6$ |

A: Structure in which plural vinyl resin particles are present in the polyester resin particle.

B: Variations in structures of each particle and mixed state of A and C.

C: Core-shell structure in which one vinyl resin particle is present in the polyester resin particle.

Volume Average Particle Diameter of Resin Composite Particles and Average Particle Diameter of Vinyl Resin Particles The volume average particle diameter of the resin composite particles and the average particle diameter of the vinyl resin particles are obtained as described above.

Transparency when Blended in Polyester Resin Product

The resin composite particle dispersion and the polyester resin particle dispersion (A1) are mixed such that the content of the vinyl resin is 18% and the mixed solution is freeze-dried to obtain a dried powder of resin particles.

4 g of the dried powder is compacted using a compacting machine (manufactured by Maekawa Testing Machine MFG. Co., Ltd.) by applying pressure with a load of 10 t for 60 seconds to obtain a disk having a diameter of 50 mm and a thickness of 2 mm. The disk is placed on the paper with Chinese characters and hiragana printed in the style of Mincho type and a font of 8 point with black, and whether or not the letters are readable through the disk is determined for classification as follows. The disk of the dried powder formed of only the polyester resin particle dispersion (A1) is determined as Classification A.

A: All letters are easily readable.

B: Some are difficult to read but readable.

C: No letters are readable.

Storage Elastic Modulus When Blended in Polyester Resin Product

The disk is cut into a column shape having a diameter of 8 mm and the cut disk is placed in a dynamic viscoelasticity measuring device (ARES, manufactured by Rheometric From the above results, it is found that when the resin composite particles according to the exemplary embodiment are blended in a polyester resin product, the transparency of the polyester resin product is less likely to be deteriorated.

In addition, it is found that when the resin composite particles according to the exemplary embodiment are blended in a polyester resin product, the storage elastic modulus of the polyester resin product is increased.

Application to Toner

Preparation of Colorant Dispersion

Carbon black (REGAL 330, manufactured by Cabot Corporation): 30 parts

Ionic surfactant (NEOGEN R, manufactured by Dai-ichi Kogyo Seiyaku Co., Ltd.): 2 parts Ion exchange water: 70 parts The above-described materials are mixed and dispersed using a homogenizer (ULTRA TURRAX T50, manufactured by IKA) for 10 minutes and then the mixture is dispersed using a high pressure impact type disperser ULTIMIZER (HJP30006, manufactured by Sugino Machine Limited) for 1 hour to obtain a colorant dispersion (solid content amount: 30%). The volume average particle diameter of the colorant particles in the colorant dispersion is 60 nm.

Preparation of Release Agent Dispersion

Paraffin wax (HNP0190 manufactured by Nippon Seiro Co., Ltd.): 30 parts

Ionic surfactant (NEOGEN R, manufactured by Dai-ichi Kogyo Seiyaku Co., Ltd.): 2 parts Ion exchange water: 70 parts The above-described materials are mixed and the mixture is heated to 120° C., dispersed using a homogenizer (ULTRA TURRAX T50, manufactured by IKA) for 10 minutes, and then dispersed using a pressure discharge type Gaulin homogenizer for 5 hours to prepare a release agent dispersion (solid content amount: 30%). The volume average particle diameter of the release agent particles in the release agent dispersion is 182 nm.

Preparation of Carrier

Ferrite particles (manufactured by Powder Tech Co., Ltd., average particle diameter: 50 μm): 100 parts Polymethyl methacrylate (manufactured by Mitsubishi Rayon Co., Ltd., weight average molecular weight: 95,000): 1.5 parts Toluene: 500 parts The above-described materials are put into a pressure type kneader and stirred for 15 minutes. Then, the pressure is reduced and the temperature is increased to 70° C. under stirring to distill away toluene. Subsequently, cooling is performed and the resultant is sieved using a sieve having an opening of 105 μm, thereby obtaining a resin coated ferrite carrier.

EXAMPLE 11

Preparation of Toner (T1)

Preparation of Toner Particles

Polyester resin particle dispersion (A1): 52 parts

Colorant Dispersion: 10 parts

Release agent dispersion: 8 parts

Ion exchange water: 70 parts

Anionic surfactant (NEOGENRK, manufactured by Daiichi Kogyo Seiyaku Co., Ltd., 20% solution): 2 parts First Aggregated Particle Forming Process The above-described materials are put into a reaction vessel equipped with a thermometer, a pH meter, and a stirrer, and heated to a temperature 30° C. from the outside using a mantle heater, and the temperature is maintained for 30 minutes under stirring at the number of stirring revolutions of 150 rpm. Thereafter, a 0.3 N aqueous nitric acid solution is added and the pH is adjusted to 4.0. Next, while dispersing the mixture using a homogenizer (ULTRA TURRAX T50, manufactured by IKA), 14 parts of a 1.0% aqueous aluminum sulfate solution is added. Next, the temperature is increased to 50° C. under stirring and the particle size of the aggregated particles (first aggregated particles) is measured by a COULTER MULTISIZER II (manufactured by Beckman Coulter Inc.). Thus, it is confirmed that the volume average particle diameter is 5.0 μm.

Second Aggregated Particle Forming Process and Coalescence Process

Next, a mixed dispersion of 14 parts of the polyester resin particle dispersion (A1) and 16 parts of the resin composite particle dispersion (P1) is added to the first aggregated particle dispersion. Subsequently, a 0.3 N aqueous nitric acid solution is added to adjust the pH to 4.0 and the mixture is hold for 30 minutes. The polyester resin particles and the resin composite particles are made to adhere to the surfaces of the first aggregated particles to form second aggregated particles. Thereafter, EDTA.4Na (CHELEST 40, manufactured by Chelest Corporation) is added in such an amount that it occupies 2.5% of the total solution and a 1 N aqueous sodium hydroxide solution is gently added until the pH reaches 8.5. Thereafter, while continuing stirring, heating is performed to 95° C. and the temperature is maintained for 3 hours to coalescence the second aggregated particles. Then, the reaction product is filtered, washed with ion exchange water, and then dried using a vacuum dryer to obtain toner particles (T1). The volume average particle diameter of the toner particles (T1) is 6.0 μm.

Preparation of External Toner 3 parts of first silica particles (silica particles obtained by a sol-gel method and having a surface treatment amount with hexamethyldisilazane of 5% by weight and an average primary particle diameter of 120 nm) and 1 part of second silica particles (R972, manufactured by Nippon Aerosil Co. Ltd.) are added to 100 parts of the toner particles (T1), and the materials are mixed using a 5 L HENSHEL mixer at a circumferential speed of 30 m/s for 15 minutes. Then, coarse particles are removed using a sieve having a mesh of 45 μm to obtain an external toner (T1).

Preparation of Developer 8 parts of the external toner (T1) and 92 parts of the resin coated ferrite carrier are put into a V blender and mixed under stirring for 20 minutes, and thus a developer (T1) is obtained.

EXAMPLE 12

Preparation of Toner (T2)

A toner (T2) and a developer (T2) are obtained in the same manner as in Example 11 except that in the second aggregated particle forming process, 16 parts of the resin composite particle dispersion (P1) is changed to 16 parts of the resin composite particle dispersion (P2).

EXAMPLE 13

Preparation of Toner (T3)

A toner (T3) and a developer (T3) are obtained in the same manner as in Example 11 except that in the second aggregated particle forming process, 14 parts of the polyester resin particle dispersion (A1) is changed to 22 parts thereof and 16 parts of the resin composite particle dispersion (P1) is changed to 8 parts thereof.

COMPARATIVE EXAMPLE 11

Preparation of Toner (T1C)

A toner (T1C) and a developer (T1C) are obtained in the same manner as in Example 11 except that in the second aggregated particle forming process, 14 parts of the polyester resin particle dispersion (A1) is changed to 30 parts thereof and 16 parts of the resin composite particle dispersion (P1) is changed to 0 parts.

COMPARATIVE EXAMPLE 12

Preparation of Toner (T2C)

A toner (T2C) and a developer (T2C) are obtained in the same manner as in Example 11 except that in the second aggregated particle forming process, 14 parts of the polyester resin particle dispersion (A1) is changed to 25.2 parts thereof and 16 parts of the resin composite particle dispersion (P1) is changed to 4.8 parts of the polystyrene particle dispersion (P1C).

COMPARATIVE EXAMPLE 13

Preparation of Toner (T3C)

A toner (T3C) and a developer (T3C) are obtained in the same manner as in Example 11 except that in the second aggregated particle forming process, 14 parts of the polyester resin particle dispersion (A1) is changed to 22 parts thereof and 16 parts of the resin composite particle dispersion (P1) is changed to 8 parts of the resin composite particle dispersion (P2C).

Evaluation of Toner

The respective toners and developers are evaluated as follows. The results are shown in Table 2.

Average Diameter of Dispersed Phase of Vinyl Resin

As described above, the average diameter of the dispersed phase formed of the vinyl resin is obtained.

Toner Aggregation 20 g of the external toner is put into a resin vessel and stored for 10 hours under an environment of a temperature of 55° C. and a humidity of 50%. Then, the surface is observed visually and the degree of occurrence of aggregation is classified as below.

A: Aggregation is not confirmed.

B: Aggregation is confirmed but when the vessel is tilted, aggregation is loosened and toner flows.

C: Aggregation is clearly confirmed and even when the vessel is tilted, aggregation is not loosened.

Low Temperature Fixability

A developing device of a modified machine of DOCUCENTRE 400 manufactured by Fuji Xerox Co., Ltd. (which is modified by being provided with an external fixing machine having a variable fixing temperature) is filled with 100 g of the developer to form an image having a size of 50 mm×50 mm, an amount of the toner applied of 10 g/m$^2$ and an image density of 100%. The toner image is fixed on a sheet paper at a fixing pressure of 10 kgf/cm$^2$ and a fixing speed of 180 mm/sec. At this time, the fixing temperature is increased in increments of 5° C. and a temperature at which an offset (a phenomenon that an image is transferred to a fixing member due to insufficient melting of a toner image) of a low temperature side does not occur (lowest fixing temperature) is classified as below.

A: 130° C. or lower

B: higher than 130° C. and 150° C. or lower

C: higher than 150° C.

Image Defect

After a developing device of a modified machine of DOCUCENTRE 400 manufactured by Fuji Xerox Co., Ltd. is filled with 100 g of the developer, an image having a pixel density of 1% is continuously formed on 2,000 sheets of A4 paper in an environment of a temperature of 23° C. and a relative humidity of 45% and is subsequently continuously formed on 2,000 sheets of A4 paper in an environment of a temperature of 27° C. and a relative humidity of 80%. Thereafter, an image having an image density of 100% and a pixel density of 100% (black solid image) is formed on a sheet in an environment of a temperature of 27° C. and a relative humidity of 80% and an image having an image density of 0% and a pixel density of 0% (blank sheet) is subsequently formed on a sheet. The black solid image and the blank sheet are visually observed and the degree of occurrence of image defects is classified as below.

A: No image defects are confirmed in the black solid image and blank sheet.

B: 1 to 9 streaks, in total, are confirmed as white streaks in the black solid image and black streaks in the blank sheet.

C: 10 or more streaks, in total, are confirmed as white streaks in the black solid image and black streaks in the blank sheet.

TABLE 2

| | Toner | Resin composite particle dispersion or polystyrene particle dispersion | Content of vinyl resin with respect to total toner particles | Average diameter of dispersed phase of vinyl resin | Toner aggregation | Low temperature fixability | Image defect |
|---|---|---|---|---|---|---|---|
| Example 11 | T1 | P1 | 4.8% by weight | 25 nm | A | A | A |
| Example 12 | T2 | P2 | 4.8% by weight | 22 nm | A | A | A |
| Example 13 | T3 | P1 | 2.4% by weight | 25 nm | A | A | A |
| Comparative Example 11 | T1C | — | 0% by weight | — | C | A | C |
| Comparative Example 12 | T2C | P1C | 4.8% by weight | 191 nm | B | C | C |
| Comparative Example 13 | T3C | P2C | 4.8% by weight | 184 nm | B | B | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A resin composite particle comprising:

a continuous phase formed of a polyester resin; and a dispersed phase dispersed in the continuous phase, wherein the dispersed phase is comprised of a plurality of particles of a vinyl resin dispersed throughout the continuous phase, a volume average particle diameter of the resin composite particles being from 50 nm to 1,000 nm.

2. The resin composite particle according to claim 1, wherein the volume average particle diameter of the resin composite particles is from 100 nm to 500 nm.

3. The resin composite particle according to claim 1, wherein an average diameter of particles of the plurality of particles of the vinyl resin is from 10 nm to 50 nm.

4. The resin composite particle according to claim 1, wherein a content of the vinyl resin is from 10% by weight to 50% by weight with respect to the total weight of the resin composite particles.

5. An electrostatic charge image developing toner comprising:

a toner particle that contains a binder resin including a polyester resin and having a dispersed phase formed of a vinyl resin derived from the resin composite particles according to claim 1.

6. An electrostatic charge image developing toner comprising:

a toner particle comprised of a core and a coating layer upon the core, wherein the coating layer contains a binder resin comprised of a continuous phase formed of a polyester resin and a dispersed phase formed of vinyl resin particles dispersed throughout the continuous phase, and the core contains a binder resin including a polyester resin and does not include a dispersed phase formed of vinyl resin particles dispersed throughout the polyester resin.

7. The electrostatic charge image developing toner according to claim 6, wherein a content of a vinyl resin included in the coating layer is 1% by weight to 5% by weight with respect to the total weight of toner particles.

8. An electrostatic charge image developing toner comprising:

a toner particle comprised of a core and a coating layer upon the core, wherein the coating layer contains a binder resin comprised of aggregated resin composite particles comprised of a continuous phase formed of a polyester resin and a dispersed phase formed of vinyl resin particles dispersed throughout the continuous phase, and the core contains a binder resin including a polyester resin and does not include a dispersed phase formed of vinyl resin particles dispersed throughout the polyester resin.

9. An electrostatic charge image developer comprising:

a carrier; and the electrostatic charge image developing toner according to claim 6.

10. The electrostatic charge image developing toner according to claim 6, wherein the binder resin of the coating layer is derived from resin composite particles comprising the continuous phase formed of the polyester resin and the dispersed phase formed of the vinyl resin particles dispersed throughout the continuous phase, wherein a volume average particle diameter of the resin composite particles is from 50 nm to 1,000 nm.

11. The electrostatic charge image developing toner according to claim 10, wherein an average diameter of particles of the vinyl resin particles in the binder resin of the coating layer is from 10 nm to 50 nm.

12. An electrostatic charge image developer comprising:

a carrier; and the electrostatic charge image developing toner according to claim 8.

* * * * *